US005327204A

United States Patent [19]

Sculley et al.

[11] Patent Number: 5,327,204

[45] Date of Patent: Jul. 5, 1994

[54] RELEASE AGENT MANAGEMENT CONTROL

[75] Inventors: Michael J. Sculley; Mark S. Amico, both of Rochester; Wayne D. Drinkwater, Fairport; David M. Thompson, Webster, all of N.Y.

[73] Assignee: Xerox Corporation, Stamford, Conn.

[21] Appl. No.: 156,333

[22] Filed: Nov. 22, 1993

[51] Int. Cl.[5] ..... G03G 15/20

[52] U.S. Cl. ..... 355/284; 219/216; 219/469; 355/282

[58] Field of Search ..... 355/284, 289, 290, 282, 355/285, 283; 219/216, 469, 471; 432/60, 59; 430/98, 99; 118/60

[56] References Cited

U.S. PATENT DOCUMENTS

| | | | |
|---|---|---|---|
| 4,079,229 | 3/1978 | Takiguchi | 219/216 |
| 4,272,666 | 6/1981 | Collin | 219/216 |
| 4,429,990 | 2/1984 | Tamary | 219/469 X |
| 4,496,234 | 1/1985 | Schram . | |
| 4,549,803 | 10/1985 | Ohno et al. . | |
| 4,593,992 | 6/1986 | Yoshinaga et al. | 219/216 X |
| 4,920,382 | 4/1990 | Mills et al. | 355/284 |
| 4,942,433 | 7/1990 | Stuart | 355/284 |
| 5,099,289 | 3/1992 | Kurotori et al. | 355/290 |
| 5,132,739 | 7/1992 | Mauer et al. | 355/284 |
| 5,155,531 | 10/1992 | Kurotori et al. | 355/215 |
| 5,202,734 | 4/1993 | Pawlik et al. | 355/284 |
| 5,212,527 | 5/1993 | Fromm et al. | 355/284 |
| 5,214,481 | 5/1993 | Hoover | 355/285 |
| 5,227,270 | 7/1993 | Scheuer et al. | 430/31 |

*Primary Examiner*—A. T. Grimley
*Assistant Examiner*—T. A. Dang

[57] ABSTRACT

A release agent management system incorporated in an electrophotographic printing machine having a heat and pressure fuser assembly. The fuser assembly includes a heated fuser roll, a pressure roll and a wick for applying fuser oil to the surface of the heated fuser roll. The wick is moved into and out of engagement with the fuser roll and release agent material is supplied to the wick in accordance with the number of prints fused from which a print equivalency value is calculated. The print equivalency corresponds favorably to actual oil consumed. A predetermined print equivalency value is used for determining when oil is supplied to the wick.

19 Claims, 8 Drawing Sheets

RELEASE AGENT MANAGEMENT CONTROL

BACKGROUND OF THE INVENTION

This invention relates generally to a fuser release agent management system for an electrophotographic printing machine, and more particularly to apparatus for controlling the dispensing of release agent material in accordance a calculated print equivalency value for prints fused which corresponds very closely to the amount of release agent consumed.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with an adhesive material, such as a silicone rubber or other low surface energy elastomer or, for example, tetrafluoroethylene resin sold by E. I. DuPont De Nemours under the trademark Teflon. In these fusing systems, however, since the toner image is tackified by heat, it frequently happens that a part of the image carried on the supporting substrate will be retained by the heated fuser roller and not penetrate into the substrate surface. The tackified toner may stick to the surface of the fuser roll and offset to a subsequent sheet of support substrate or offset to the pressure roll when there is no sheet passing through a fuser nip resulting in contamination of the pressure roll with subsequent offset of toner from the pressure roll to the image substrate.

To obviate the foregoing toner offset problem, it has been common practice to utilize toner release agents such as silicone oil, in particular, polydimethyl silicone oil, which is applied to the fuser roll surface to a thickness of the order of about 1 micron to act as a toner release material. These materials possess a relatively low surface energy and have been found to be materials that are suitable for use in the heated fuser roll environment. In practice, a thin layer of silicone oil is applied to the surface of the heated roll to form an interface between the roll surface and the toner image carried on the support material. Thus, a low surface energy, easily parted layer is presented to the toners that pass through the fuser nip and thereby prevents toner from adhering to the fuser roll surface. Apparatus for applying the release agent material to a fuser member is commonly referred to as a release agent management system.

Release agent management systems designed for copier environments having relatively low average monthly print volumes (AMPV) and lower stress documents are not suitable for high volume printers, particularly those capable of creating color or highlight color images. With the high AMPV expected from high speed printers and the high stress matrices expected from tri-level xerography the exposure to offsetting (from low oil) is a large concern. Simply increasing the oil addition rate would cause problems with excess oil on first output prints and would stress the oil removal system increasing the oil on print defect exhibited in the past by high volume printers.

As will be appreciated, it is desirable to provide a release agent management system which can adequately handle the AMPV and high stress matrices required by high speed printers and tri-level imaging devices.

The following publications may be relevant to various aspects of the present invention:

U.S. Pat. No. 5,099,289 discloses a fuser silicone oil dispenser which utilizes a metering member and a donor member and which is capable at operating in two modes to vary the amount of silicone oil delivered to the fuser.

U.S. Pat. No. 4,942,433 describes a release liquid applying device utilizing a rotating wick that is engaged by a fusing roller wherein the wick at times is prevented from rotating, thereby reducing the oil applied to the fuser roller.

U.S. Pat. No. 4,593,992 describes a device for intermittently applying the fuser release agent to the rotating fuser roll.

JP-A-164,085 describes a fuser assembly in which a solenoid actuated lever increases or decreases the amount of release agent applied to the fuser assembly by the donor member.

JP-A-476,672 describes a fuser member in which another solenoid actuated lever arm rotates to disconnect the donor member from the fuser oil supply to thereby reduce the amount of oil applied to the heated fuser member.

JP-A-107,979 describes a fuser assembly in which an adjusting blade is regulated as to its contact with a donor member to vary the amount of release oil applied to the heated fuser member.

JP-A-35,569 describes a heated fuser assembly in which the speed of the donor member is regulated to control the amount of oil supplied to the heated fuser roll.

U.S. Pat. No. 4,920,382 granted to Mills et al on Apr. 24, 1990 discloses a roller fixing device, for example, a pressure roller fuser includes a roller to which a release agent is to be applied by a wick. To correct a tendency of certain wicks to apply the release liquid in a pattern including spots of locally excessive liquid, the wick is disengaged from the roller sufficiently prior to the fixing operation to permit the liquid to spread eliminating the spots of locally excessive liquid. Preferably, the roller completes at least one revolution in contact with another roller after disengagement and prior to the beginning of fixing. To assist that spread, a sheet of more absorbent material, for example paper, is fed through the fixing operation during this period. This mode of operation is used for specific receiver sheets and toner conditions, for example, those encountered in making color transparencies. A more conventional wicking mode is used for other reproductions on paper and black toner transparencies.

U.S. Pat. No. 5,132,739 granted to Mauer et al relates the curing of background defects by adjusting the oiling algorithm used in applying offset preventing liquid in the fuser. According to a preferred embodiment, no oil or less oil is applied when fusing the first image to the receiving sheet when the apparatus is operating in the duplex mode. When operating in the simplex mode or fusing the second image to a sheet, a normal amount of liquid is applied.

U.S. Pat. No. 4,549,803 to Ohno et al, issued Oct. 29, 1985 and U.S. Pat. No. 4,593,922 to Yoshinaga et al, issued Jun. 10, 1986, both show fixing devices in which fixing conditions are changed between paper stock and transparency stock to reduce the amount of oil applied when transparencies are being fixed.

U.S. Pat. No. 4,429,990, issued Feb. 7, 1984 to E. J. Tamary discloses an applicator for applying release liquid to a fusing roller which contacts the toner image. The applicator, commonly called a rotating wick, includes a hollow, porous roller which is supplied with fusing oil internally. The applicator has an inner supply tube with holes in it and is covered by a porous material having a surface of wool or a heat resistant synthetic wicking material. The applicator is rotatable by the fusing roller. The applicator is movable into and out of engagement with the roller according to a program which prevents excess buildup of oil on the roller, which otherwise would stain the receiving sheet.

U.S. Pat. No. 5,214,481 granted to Linn C. Hoover on May 25, 1993 relates to an oil application system which is controlled by actuation and deactuation of a wick actuation solenoid in the receiving apparatus. The solenoid depresses a wick plunger to rotate the wick into rolling engagement with a fusing roller, i.e., the wick is moved clockwise around a wick pivot point, into a first position. The wick is spring urged to a second position separated from roller when the solenoid is not actuated and the plunger is not depressed. Movement of the right end of actuator arm downward causes the left end to pivot upward. A pin is coupled between the left end of an arm and cradle to move the cradle clockwise around a pivot. A typical wicking algorithm would call for deactivation of the solenoid after a certain number of copies to prevent over-oiling of the fusing roller. The algorithm may vary according to the type of receiving sheet and the type of image. Such algorithms are well known in the art and are implemented by a logic and control. It is known that the greater force applied between the wick and the fosing roller, the greater the oiling. Thus, an alternative construction would move the wick between positions in which more and less oil is applied. In the embodiment shown, the wick is either applying oil or not.

U.S. Pat. No. 5,212,527 granted to From et al on May 18, 1993 describes a release agent management system including a metering roll and a donor roll in which a metering blade structure for metering silicone oil onto the metering roll has two modes of operation. In one mode, a wiping action of the metering blade meters a relatively large quantity of silicone oil to the roll surface and in the other mode of operation, a doctoring action is affected for metering a relatively small amount of silicone oil to the roll surface.

U.S. Pat. No. 5,227,270 granted on Jul. 13, 1993 to Scheuer et al discloses a single pass tri-level imaging apparatus wherein a pair of Electrostatic Voltmeters (ESV) are utilized to monitor various control patch voltages to allow for feedback control of Infra-Red Densitometer (IRD) readings.

The ESV readings are used to adjust the IRD readings of each toner patch. For the black toner patch, readings of an ESV positioned between two developer housing structures are used to monitor the patch voltage. If the voltage is above target (high development field) the IRD reading is increased by an amount proportional to the voltage error. For the color toner patch, readings using an ESV positioned upstream of the developer housing structures and the dark decay projection to the color housing are used to make a similar correction to the color toner patch IRD readings (but opposite in sign because, for color, a lower voltage results in a higher development field).

U.S. Pat. No. 5,202,734 granted to Pawlik et al on Apr. 13, 1993 discloses A release agent management system including a metering roll supported for contact with release agent material contained in a sump. A donor roll is provided for applying oil deposited thereon by the metering roll. Prior to fusing taking place, the donor roll is supported in pressure engagement with the fuser roll and out of contact with the metering roll. During fusing the donor roll is cammed into engagement with the metering roll.

U.S. Pat. No. 4,496,234 granted to Joseph G. Schram on Jan. 29, 1985 discloses a release agent system for use with a heat and pressure fuser. The system is characterized by the use of a reciprocating, positive displacement pump for delivering silicone oil the heated fuser roll. The pump is actuated in response to the fuser rolls being engaged and disengaged, such movement being adapted to act against one or the other of a pair of springs which in cooperation with the oil being pumped forms a damper system which is utilized to control the quantity of oil delivered. The springs and oil cause the velocity of the pump's piston to decay with time which results in more oil being pumped initially.

U.S. Pat. No. 4,079,229 granted to Koichi Takiguchi on Mar. 14, 1978 discloses a contacting and heating fixing apparatus comprising a first roll of which the surface has a coating of a heat-resistant material with which a toner image of a material to be fixed comes into contact, a second roll for pressing, heating and fixing the material to be fixed in cooperation with said first roll, and a supply mechanism for supplying an offset inhibitor liquid to said heat-resistant parting material on the surface of said first roll, characterized in that supplying of the offset inhibitor liquid from said supply mechanism is made only at warm-up time of a copier.

U.S. Pat. No. 4,593,992 granted to Takada et al on Jun. 10, 1986 discloses an image forming apparatus for forming an unfixed image on a recording material includes a fixing device having a pair of rotatable members for holding therebetween and conveying the recording material to fix the unfixed image on the recording material, speed control device for variably controlling the fixing rotational speed of the pair of rotatable members to a first fixing speed and a second fixing speed lower than the first fixing speed, application apparatus for intermittently supplying a parting agent to at least one of the pair of rotatable members, and application control apparatus for variably controlling the application acting period of the application apparatus in accordance with the fixing rotational speed of the pair of rotatable members variably set by the speed control device.

U.S. Pat. No. 4,429,990 granted to Ernest J. Tamary on Feb. 7, 1984 discloses apparatus for controlling the application of fuser release material such as fuser oil to a roller fuser in an electrographic copier. The number of fixable images or the number of photoconductor frames are counted after the start of a copy run and compared with the number of copies which exit from the copier to determine if the two counts bear a preselected numerical relationship to each other. If they do, fuser oil is applied to the roller fuser; if they do not, application of fuser oil is discontinued until the two counts bear such numerical relationship.

U.S. Pat. No. 4,272,666 granted to Vittorio Collin on Jun. 9, 1981 discloses a fusing rolls fixing unit having a toner antisticky liquid supply device wetting the surface of the fixing rolls to prevent adhesion of toner particles thereto. The antisticky liquid supply device is discontinuously operated for applying liquid to the fixing rolls only one time for each copy-run executed.

BRIEF SUMMARY OF THE INVENTION

In accordance the present invention, there is provided an apparatus for applying release agent material or an offset preventing liquid to a fuser member. The apparatus comprises a wick member adapted to be cammed in and out of contact with a heated fuser roll. The purpose of camming the wick structure is to limit the application of oil to the fuser roll when there is no paper being fed through the fuser (cycle up, dead cycling and cycle down). This will allow an increase in the oil addition rate without causing problems with excess oil on first output prints and minimizing the oil seen by the oil removal system. A pump is employed for conveying oil to the wick A release agent dispensing control calculates print equivalences and dispenses release agent material such as silicone oil when a print equivalency target stored in non-volatile memory (NVM) is reached. Since the first prints of a job will use more oil than the steady state prints, they are weighted with higher print equivalency values than subsequent prints.

The benefit of the control of the present invention is that it "counts" the print equivalency similar to the way that the oil is being taken out of the system, rather than "counting" the print equivalency with set NVM values. In at least one prior art control using set NVM values, eight NVM locations were used to store print equivalency values which did not favorably correspond to oil usage. The other benefit of this control is that it makes more efficient use of NVM space (2 NVM locations compared 8 NVM locations).

An algorithm used for dispensing silicone oil uses two non-volatile memory (NVM) locations, one for a target value and one for a print equivalency value. A formula for computing print equivalences is as follows:

If a calculated print equivalency value $<=$ a predetermined print equivalency value, then the print equivalency = (the predetermined print equivalency value/number of prints) + 1

If a calculated print equivalency value $>$ a predetermined print equivalency value, then the print equivalency = 1.

The release agent dispensing control enables dynamic oil dispensing by varying the target value stored in NVM based upon printer usage. Typically the oil applied to the fuser roll is low during long job runs and higher during short job runs. Also, the short job run mode will run less prints per hour than a long job run mode because the short job is intermittent and the long job approaches continuous operation. When the dynamic oil dispensing control is enabled it will decrease the target (increases oil addition rate) for high print per hour jobs and increase the target (decreases oil addition rate) for low print per hour jobs. This feature customizes the machine to the job environment.

Other features of the present invention will become apparent as the following description proceeds and upon reference to the drawings, in which:

While the present invention will be described in connection with a tri-level printing, it will be understood that it is not intended to limit the invention to that type of printing. On the contrary, it is intended to cover all alternatives, modifications, and equivalents as may be included within the spirit and scope of the invention as defined by the appended claims.

DETAILED DESCRIPTION OF THE PREFERRED EMBODIMENT OF THE INVENTION

Figure 1A:
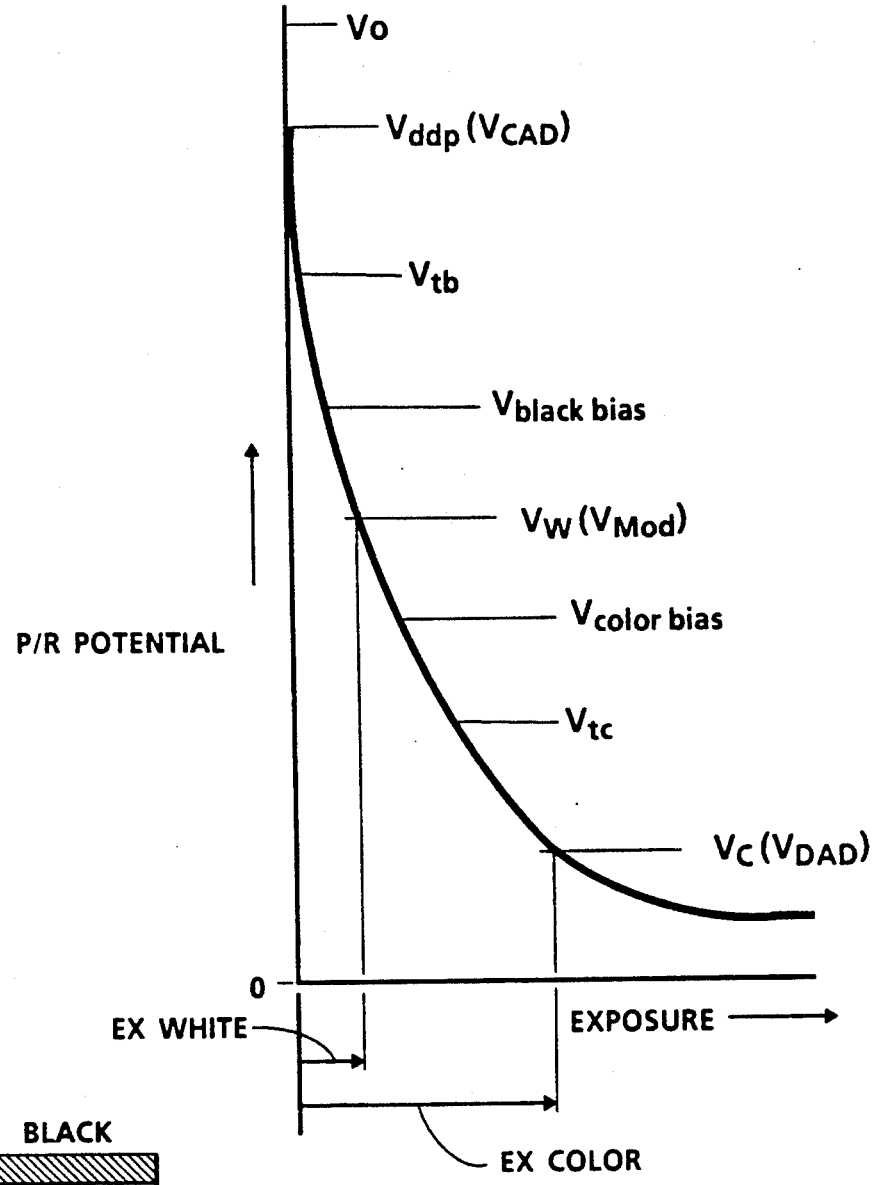
FIG. 1a PRIOR ART
FIG. 1*a* is a plot of photoreceptor potential versus exposure illustrating a tri-level electrostatic latent image.
Figure 1B:
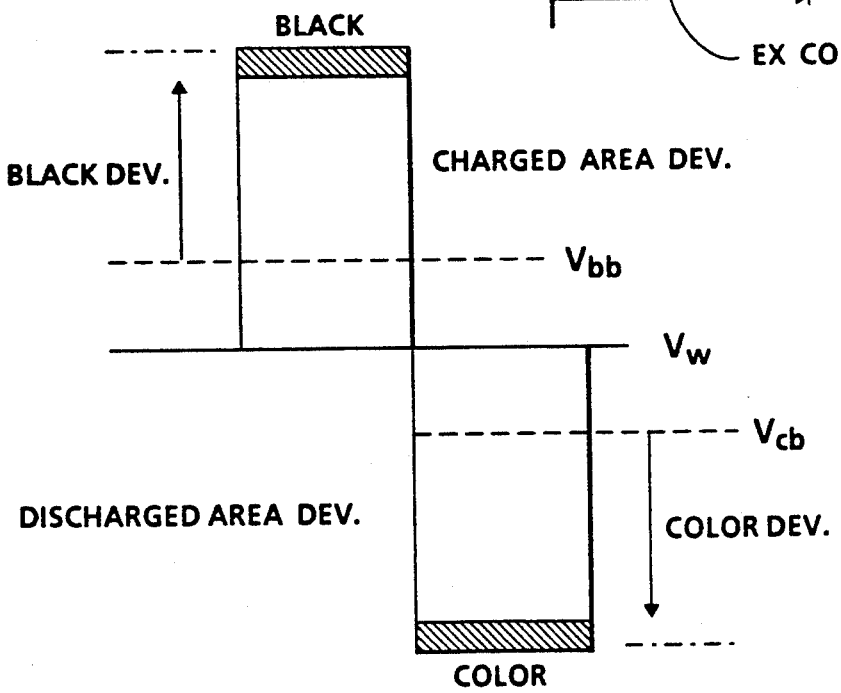
FIG. 1b PRIOR ART
FIG. 1*b* a plot of photoreceptor potential illustrating single-pass, highlight color latent image characteristics.

For a better understanding of the concept of tri-level, highlight color imaging, a description thereof will now be made with reference to FIGS. 1*a* and 1*b*. FIG. 1*a* shows a PhotoInduced Discharge Curve (PIDC) for a tri-level electrostatic latent image according to the present invention. Here $V_0$ is the initial charge level, $V_{ddp}$ ($V_{CAD}$) the dark discharge potential (unexposed), $V_w$ ($V_{Mod}$) the white or background discharge level and $V_c$ ($V_{DAD}$) the photoreceptor residual potential (full exposure using a three level Raster Output Scanner, ROS). Nominal voltage values for $V_{CAD}$, $V_{Mod}$ and $V_{DAD}$ are, for example, 788, 423 and 123, respectively.

Color discrimination in the development of the electrostatic latent image is achieved when passing the photoreceptor through two developer housings in tandem or in a single pass by electrically biasing the housings to voltages which are offset from the background voltage $V_{Mod}$, the direction of offset depending on the polarity or sign of toner in the housing. One housing (for the sake of illustration, the second) contains developer with black toner having triboelectric properties (positively charged) such that the toner is driven to the most highly charged ($V_{ddp}$) areas of the latent image by the electrostatic field between the photoreceptor and the development rolls biased at $V_{black\ bias}$ ($V_{bb}$) as shown in FIG. 1*b*. Conversely, the triboelectric charge (negative charge) on the colored toner in the first housing is chosen so that the toner is urged towards parts of the latent image at residual potential, $V_{DAD}$ by the electrostatic field existing between the photoreceptor and the development rolls in the first housing which are biased to $V_{color\ bias}$, ($V_{cb}$). Nominal voltage levels for $V_{bb}$ and $V_{cb}$ are 641 and 294, respectively.

Figure 2:
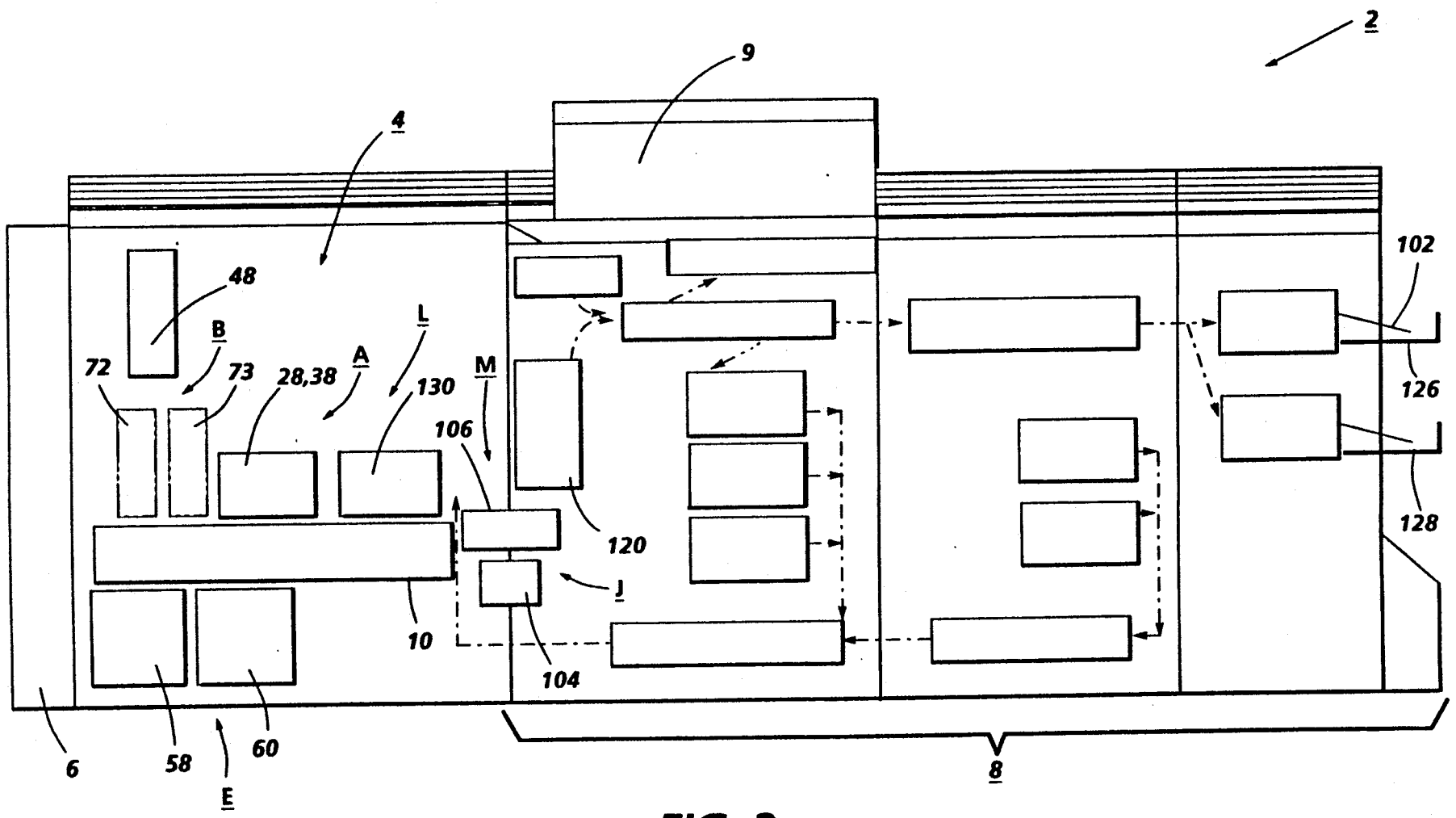
FIG. 2 is schematic illustration of a printing apparatus incorporating the inventive features of the invention.
Figure 3:
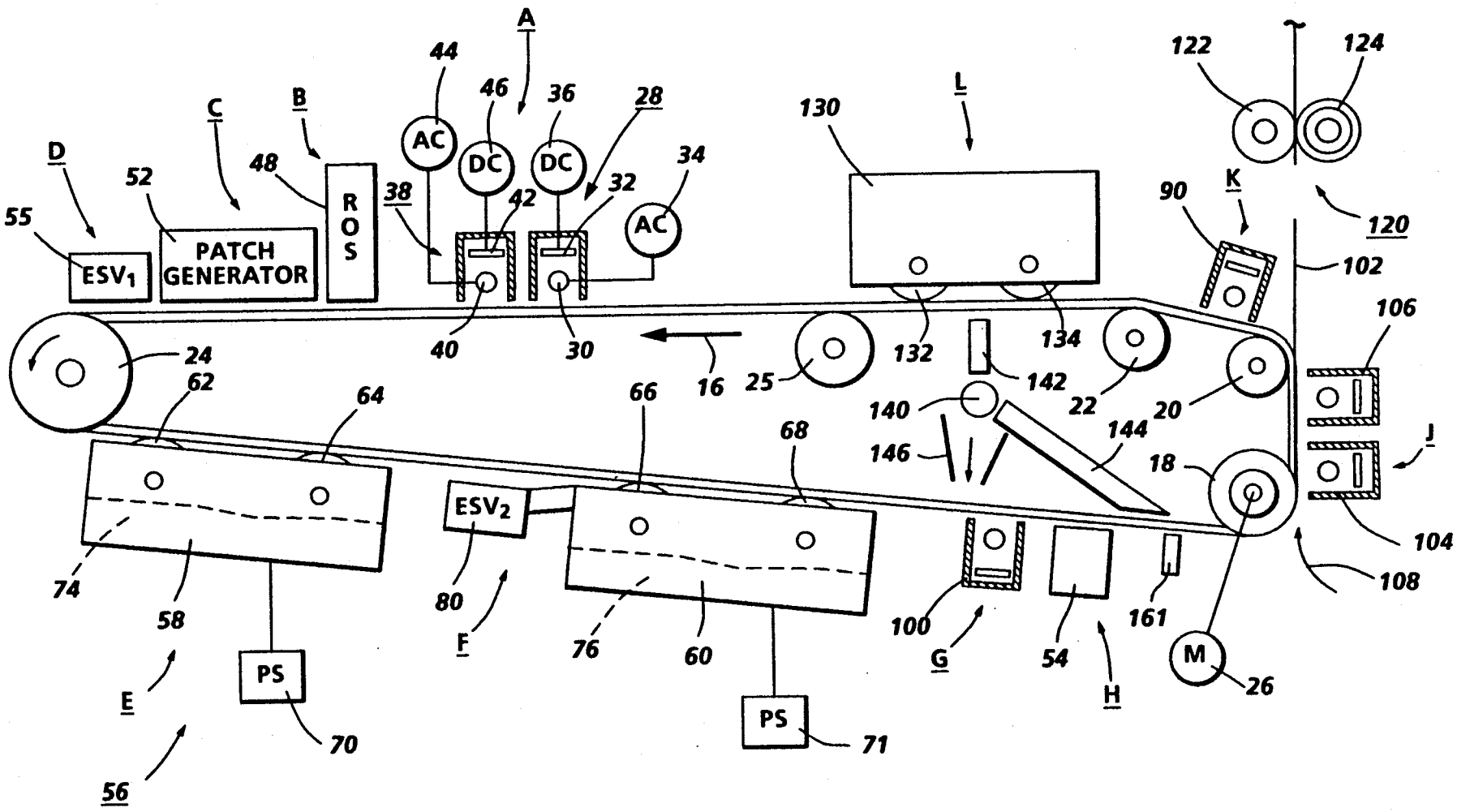
FIG. 3*a* schematic of the xerographic process stations including the active members for image formation as well as the control members operatively associated therewith of the printing apparatus illustrated in FIG. 2.

As shown in FIGS. 2 and 3, a highlight color printing apparatus 2 in which the invention may be utilized comprises a xerographic processor module 4, an electronics module 6, a paper handling module 8 and a user interface (IC) 9. A charge retentive member in the form of an Active Matrix (AMAT) photoreceptor belt 10 is mounted for movement in an endless path past a charging station A, an exposure station B, a test patch generator station C, a first Electrostatic Voltmeter (ESV) station D, a developer station E, a second ESV station F within the developer station E, a pretransfer station G, a toner patch reading station H where developed toner patches are sensed, a transfer station J, a preclean station K, cleaning station L and a fusing station M. Belt 10 moves in the direction of arrow 16 to advance successive portions thereof sequentially through the various processing stations disposed about the path of movement thereof. Belt 10 is entrained about a plurality of rollers 18, 20, 22, 24 and 25, the former of which can be used as a drive roller and the latter of which can be used to provide suitable tensioning of the photoreceptor belt 10. Motor 26 rotates roller 18 to advance belt 10 in the direction of arrow 16. Roller 18 is coupled to motor 26 by suitable means such as a belt drive, not shown. The photoreceptor belt may comprise a flexible belt photoreceptor. Typical belt photoreceptors are disclosed in U.S. Pat. Nos. 4,588,667, 4,654,284 and 4,780,385.

As can be seen by further reference to FIGS. 2 and 3, initially successive portions of belt 10 pass through charging station A. At charging station A, a primary corona discharge device in the form of dicorotron indicated generally by the reference numeral 28, charges the belt 10 to a selectively high uniform negative potential, $V_0$. As noted above, the initial charge decays to a dark decay discharge voltage, $V_{ddp}$, ($V_{CAD}$). The dicorotron is a corona discharge device including a corona discharge electrode 30 and a conductive shield 32 located adjacent the electrode. The electrode is coated with relatively thick dielectric material. An AC voltage is applied to the dielectrically coated electrode via power source 34 and a DC voltage is applied to the shield 32 via a DC power supply 36. The delivery of charge to the photoconductive surface is accomplished by means of a displacement current or capacitative coupling through the dielectric material. The flow of charge to the P/R 10 is regulated by means of the DC bias applied to the dicorotron shield. In other words, the P/R will be charged to the voltage applied to the shield 32. For further details of the dicorotron construction and operation, reference may be had to U.S. Pat. No. 4,086,650 granted to Davis et al on Apr. 25, 1978.

A feedback dicorotron 38 comprising a dielectrically coated electrode 40 and a conductive shield 42 operatively interacts with the dicorotron 28 to form an integrated charging device (ICD). An AC power supply 44 is operatively connected to the electrode 40 and a DC power supply 46 is operatively connected to the conductive shield 42.

Next, the charged portions of the photoreceptor surface are advanced through exposure station B. At exposure station B, the uniformly charged photoreceptor or charge retentive surface 10 is exposed to a laser based input and/or output scanning device 48 which causes the charge retentive surface to be discharged in accordance with the output from the scanning device. Preferably the scanning device is a three level laser Raster Output Scanner (ROS). Alternatively, the ROS could be replaced by a conventional xerographic exposure device. The ROS comprises optics, sensors, laser tube and resident control or pixel board.

The photoreceptor, which is initially charged to a voltage $V_0$, undergoes dark decay to a level $V_{ddp}$ or $V_{CAD}$ equal to about −900 volts to form CAD images. When exposed at the exposure station B it is discharged to $V_c$ or $V_{DAD}$ equal to about −100 volts to form a DAD image which is near zero or ground potential in the highlight color (i.e. color other than black) parts of the image. See FIG. 1*a*. The photoreceptor is also discharged to $V_w$ or $V_{mod}$ equal to approximately minus 500 volts in the background (white) areas.

A patch generator 52 (FIGS. 3 and 4) in the form of a conventional exposure device utilized for such purpose is positioned at the patch generation station C. It serves to create toner test patches in the interdocument zone which are used both in a developed and undeveloped condition for controlling various process functions. An Infra-Red densitometer (IRD) 54 is utilized to sense or measure the voltage level of test patches after they have been developed.

After patch generation, the P/R is moved through a first ESV station D where an ESV ($ESV_1$) 55 is positioned for sensing or reading certain electrostatic charge levels (i.e. $V_{DAD}$, $V_{CAD}$, $V_{Mod}$, and $V_{tc}$) on the P/R prior to movement of these areas of the P/R moving through the development station E.

At development station E, a magnetic brush development system, indicated generally by the reference numeral 56 advances developer materials into contact with the electrostatic latent images on the P/R. The development system 56 comprises first and second developer housing structures 58 and 60. Preferably, each magnetic brush development housing includes a pair of magnetic brush developer rollers. Thus, the housing 58 contains a pair of rollers 62, 64 while the housing 60 contains a pair of magnetic brush rollers 66, 68. Each pair of rollers advances its respective developer material into contact with the latent image. Appropriate developer biasing is accomplished via power supplies 70 and 71 electrically connected to respective developer housings 58 and 60. A pair of toner replenishment devices 72 and 73 (FIG. 2) are provided for replacing the toner as it is depleted from the developer housing structures 58 and 60.

Color discrimination in the development of the electrostatic latent image is achieved by passing the photoreceptor past the two developer housings 58 and 60 in a single pass with the magnetic brush rolls 62, 64, 66 and 68 electrically biased to voltages which are offset from the background voltage $V_{Mod}$, the direction of offset depending on the polarity of toner in the housing. One housing e.g. 58 (for the sake of illustration, the first) contains red conductive magnetic brush (CMB) developer 74 having triboelectric properties (i.e. negative charge) such that it is driven to the least highly charged areas at the potential $V_{DAD}$ of the latent images by the electrostatic development field ($V_{DAD}-V_{color\ bias}$) between the photoreceptor and the development rolls 62, 64. These rolls are biased using a chopped DC bias via power supply 70.

The triboelectric charge on conductive black magnetic brush developer 76 in the second housing is chosen so that the black toner is urged towards the parts of the latent images at the most highly charged potential $V_{CAD}$ by the electrostatic development field ($V_{CAD}-V_{black\ bias}$) existing between the photoreceptor and the development rolls 66, 68. These rolls, like the rolls 62, 64, are also biased using a chopped DC bias via power supply 71. By chopped DC (CDC) bias is meant that the housing bias applied to the developer housing is alternated between two potentials, one that represents roughly the normal bias for the DAD developer, and the other that represents a bias that is considerably more negative than the normal bias, the former being identified as $V_{Bias\ Low}$ and the latter as $V_{Bias\ High}$. This alternation of the bias takes place in a periodic fashion at a given frequency, with the period of each cycle divided up between the two bias levels at a duty cycle of from 5–10% (Percent of cycle at $V_{Bias\ High}$) and 90–95% at $V_{Bias\ Low}$. In the case of the CAD image, the amplitude of both $V_{Bias\ Low}$ and $V_{Bias\ High}$ are about the same as for the DAD housing case, but the waveform is inverted in the sense that the the bias on the CAD housing is at $V_{Bias\ High}$ for a duty cycle of 90–95%. Developer bias switching between $V_{Bias\ High}$ and $V_{Bias\ Low}$ is effected automatically via the power supplies 70 and 71. For further details regarding CDC biasing, reference may be had to U.S. Pat. No. 5,080,988 granted to Germain et al on Jan. 14, 1992 and assigned to same assignee as the instant application.

In contrast, in conventional tri-level imaging as noted above, the CAD and DAD developer housing biases are set at a single value which is offset from the background voltage by approximately −100 volts. During image development, a single developer bias voltage is continuously applied to each of the developer structures. Expressed differently, the bias for each developer structure has a duty cycle of 100%.

Because the composite image developed on the photoreceptor consists of both positive and negative toner, a negative pretransfer dicorotron member 100 at the pretransfer station G is provided to condition the toner for effective transfer to a substrate using positive corona discharge.

Subsequent to image development a sheet of support material 102 (FIG. 3) is moved into contact with the toner image at transfer station J. The sheet of support material is advanced to transfer station J by conventional sheet feeding apparatus comprising a part of the paper handling module 8. Preferably, the sheet feeding apparatus includes a feed roll contacting the uppermost sheet of a stack copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station J.

Transfer station J includes a transfer dicorotron 104 which sprays positive ions onto the backside of sheet 102. This attracts the negatively charged toner powder images from the belt 10 to sheet 102. A detack dicorotron 106 is also provided for facilitating stripping of the sheets from the belt 10.

After transfer, the sheet continues to move, in the direction of arrow 108, onto a conveyor (not shown) which advances the sheet to fusing station M. Fusing station M includes a fuser assembly, indicated generally by the reference numeral 120, which permanently affixes the transferred powder image to sheet 102. Preferably, fuser assembly 120 comprises a heated fuser roller 122 having an outer coating or layer of silicone rubber and a deformable backup roller 124 comprising an outer layer comprising a copolymer of perfluoroalkyl perfluorovinyl ether with tetrafluroethylene (PFA). Sheet 102 passes between fuser roller 122 and backup roller 124 with the toner powder image contacting fuser roller 122. In this manner, the toner powder image is permanently affixed to sheet 102 after it is allowed to cool. After fusing, a chute, not shown, guides the advancing sheets 102 to a catch trays 126 and 128 (FIG. 2), for subsequent removal from the printing machine by the operator.

Figure 5:
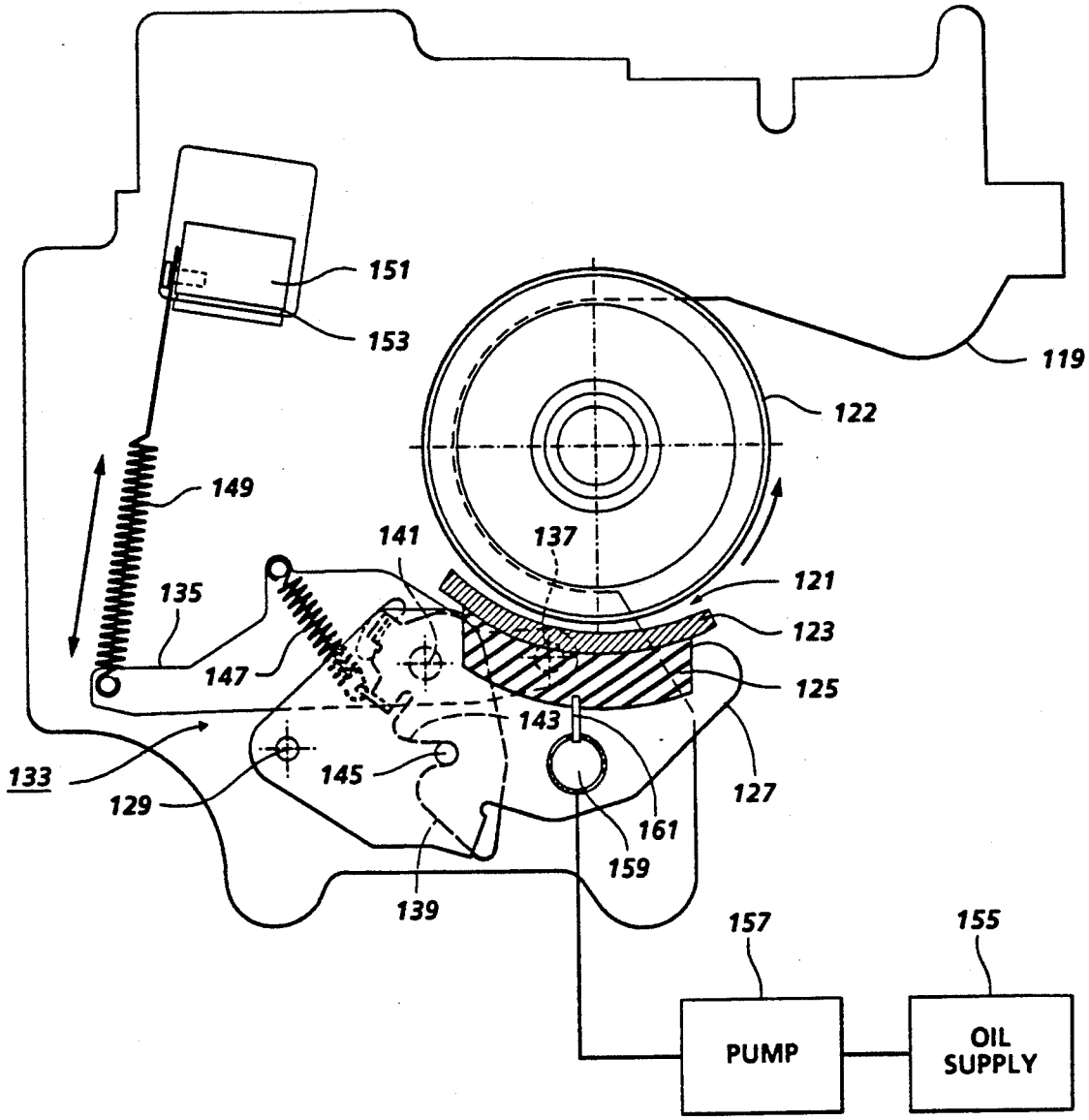
FIG. 5 is a side elevational view depicting a fuser wick engagement/disengagement mechanism with the wick disengaged from a fuser roll.
Figure 6:
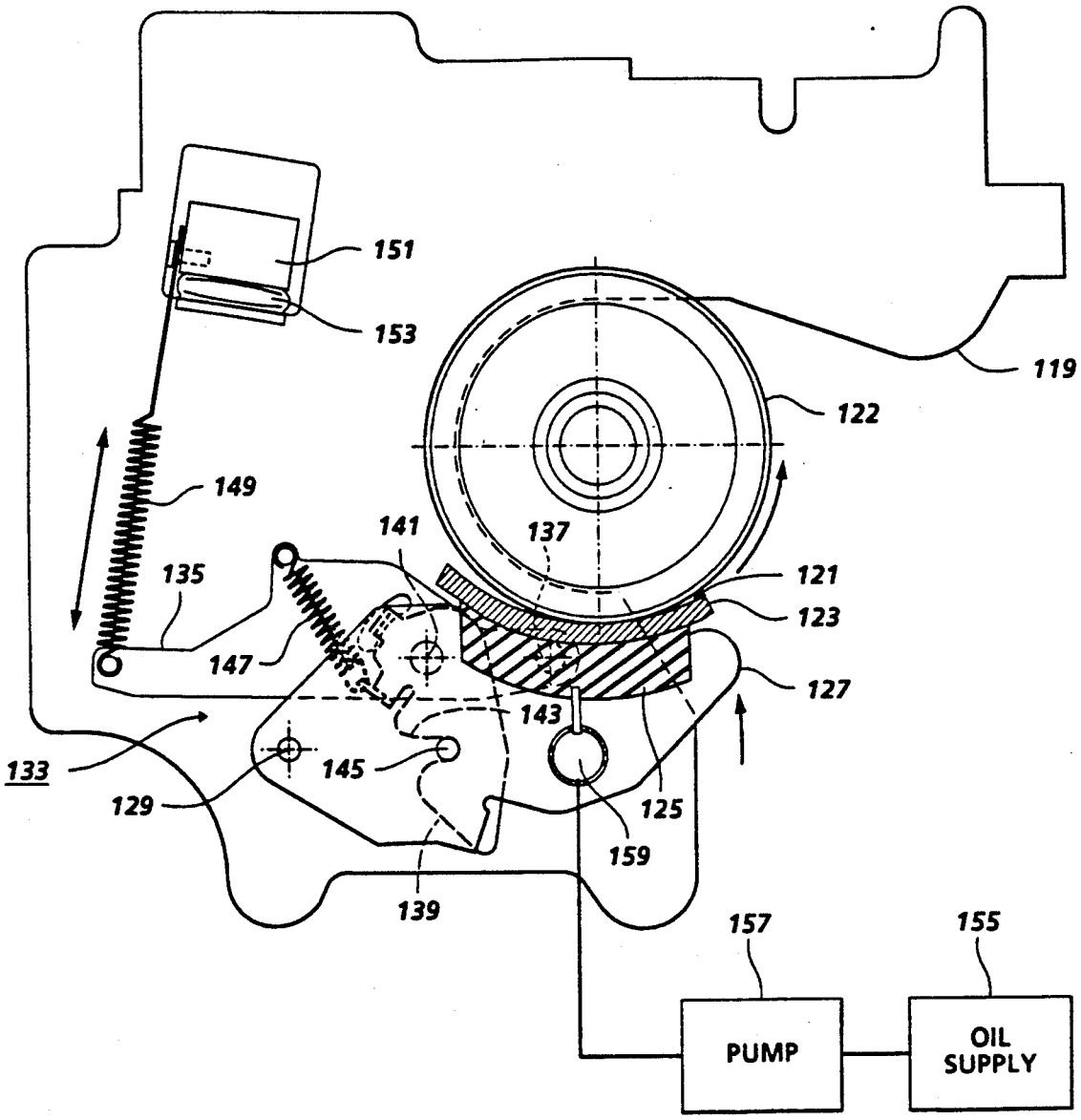
FIG. 6 is a side elevational view depicting a fuser wick engagement/disengagement mechanism with the wick contacting the fuser roll.

The fuser roller 122 is supported for rotation by a pair (only one being shown) of fuser frame members 119 (FIGS. 5 and 6). A fuser wick structure generally indicated by reference character 121 is provided for supplying release agent material to the surface of the heated fuser roller 122. The fuser wick assembly comprises a fuser wick 123 and a donor wick 125 which are supported by a wick pan assembly 127 such that fuser wick 123 can be selectively brought into engagement with (FIG. 6) and disengaged from the heated fuser roller. Wick engagement is effected during printer cycle up, dead cycling and cycle down periods. This allows an increase in the release agent material such as silicone oil being supplied to the pan assembly and to the wick structure without causing problems with excess oil on first output prints and minimizing the oil seen by the oil removal system.

The pan assembly is supported for pivotal movement by pin members 129 carried by fuser frame members 119. A linkage mechanism generally indicated by reference character 133 is provided for allowing pivoting of the pan assembly 127 for effecting engagement and disengagement of the fuser wick 123 into (FIG. 6) and out (FIG. 5) of contact with the surface of the fuser roller 122. The linkage mechanism 133 comprises a pair of pivot arm assemblies 135 which are pivotally attached to the fuser frame 119 via pivot pins 137. A pair of latch members 139 pivotally attached to the arm assemblies 135 via pins 141 are provided with notches 143 for receiving pin members 145 carried by the pan assembly 127. A pair of springs 147 attach the latch members 139 to the arm assemblies 135 for effecting movement of the former with the latter. The latch members 139 also serve to allow dropping of the wick pan assembly 127 for wick replacement when the latch members are rotated counterclockwise to release the pin members 145.

A pair of springs 149 attached at one end to the arm assemblies 135 and the other to a load bar 151 serve to effect movement of the arm assemblies in response to movement of the load bar. A supply of compressed air (not shown) serves to inflate a bladder 153 for effecting movement of the load bar in an upward direction which, in turn, effects engagement of the fuser wick with the fuser roller surface as indicated in FIG. 6.

Fuser oil from a supply 155 is periodically pumped using a pump 157, in a manner to be discussed hereinafter, into an elongated cavity 159 forming a part of the wick pan assembly and then through a plurality of orifices 161 and is dispersed along a bottom wall of the pan assembly where it is absorbed by the donor wick 125. The wicks may be fabricated from any suitable material such as Nomex TM. The fuser oil comprises silicone oil having a viscosity of 13,000 cs.

After the sheet of support material is separated from photoconductive surface of belt 10, the residual toner particles carried by the non-image areas on the photoconductive surface are removed therefrom. These particles are removed at cleaning station L. A cleaning housing 130 supports therewithin two cleaning brushes 132, 134 supported for counter-rotation with respect to the other and each supported in cleaning relationship with photoreceptor belt 10. Each brush 132, 134 is generally cylindrical in shape, with a long axis arranged generally parallel to photoreceptor belt 10, and transverse to photoreceptor movement direction 16. Brushes 132,134 each have a large number of insulative fibers mounted on base, each base respectively journaled for rotation (driving elements not shown). The brushes are typically detoned using a flicker bar and the toner so removed is transported with air moved by a vacuum source (not shown) through the gap between the housing and photoreceptor belt 10, through the insulative fibers and exhausted through a channel, not shown. A typical brush rotation speed is 1300 rpm, and the brush/-photoreceptor interference is usually about 2 mm. Brushes 132, 134 beat against flicker bars (not shown) for the release of toner carried by the brushes and for effecting suitable tribo charging of the brush fibers.

Subsequent to cleaning, a discharge lamp 140 floods the photoconductive surface 10 with light to dissipate any residual negative electrostatic charges remaining prior to the charging thereof for the successive imaging cycles. To this end, a light pipe 142 is provided. Another light pipe 144 serves to illuminate the backside of the P/R downstream of the pretransfer dicorotron 100. The P/R is also subjected to flood illumination from the lamp 140 via a light channel 146.

Figure 4:
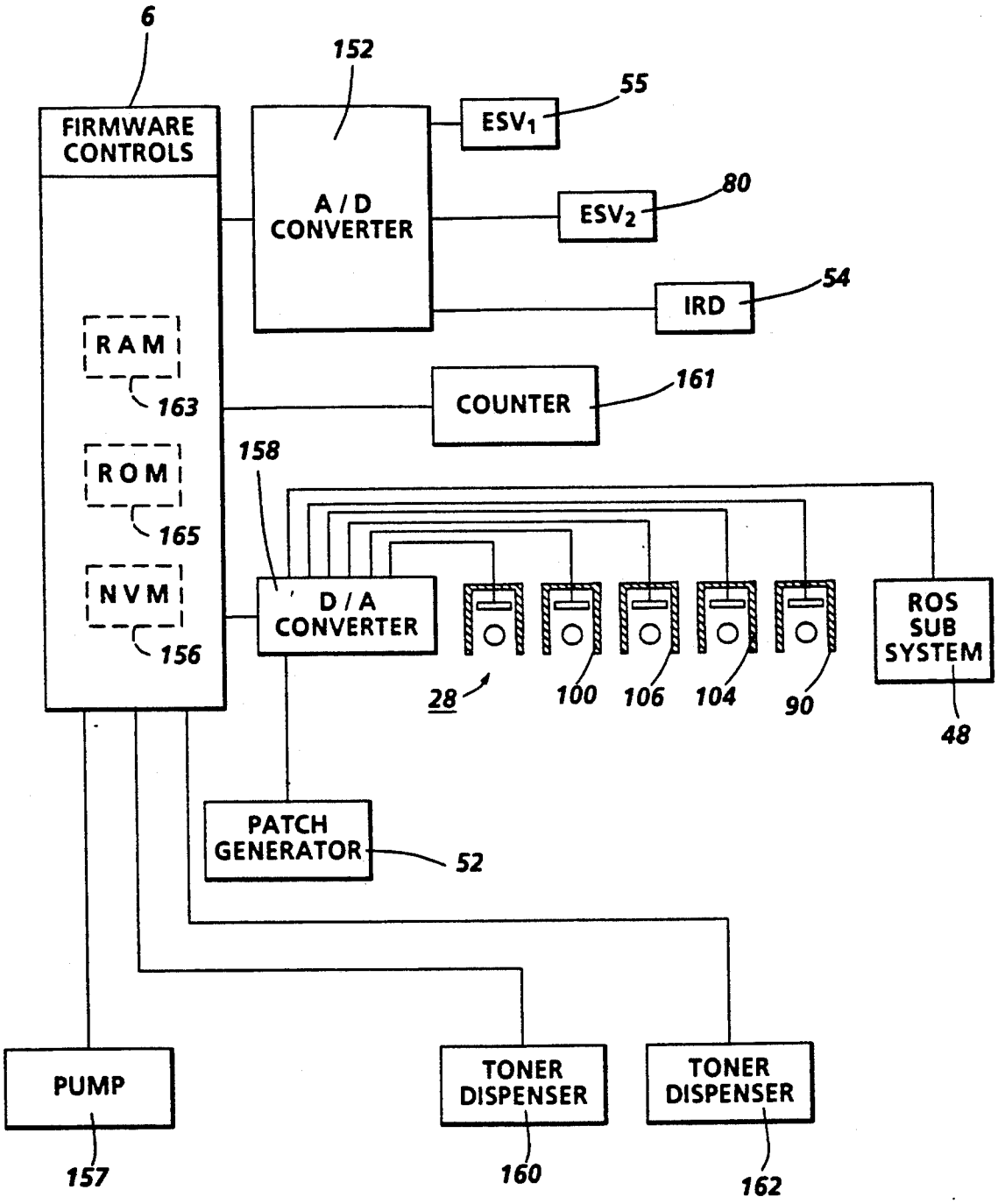
FIG. 4 is a block diagram illustrating the interconnection among active components of the xerographic process module and the control devices utilized to control them.

FIG. 4 depicts the the interconnection among active components of the xerographic process module 4 and the sensing or measuring devices utilized to control them. As illustrated therein, $ESV_1$, $ESV_2$ and IRD 54 are operatively connected to a control board 150 through an analog to digital (A/D) converter 152. $ESV_1$ and $ESV_2$ produce analog readings in the range of 0 to 10 volts which are converted by Analog to Digital (A/D) converter 152 to digital values in the range 0–255. Each bit corresponds to 0.040 volts (10/255) which is equivalent to photoreceptor voltages in the range 0–1500 where one bit equals 5.88 volts (1500/255).

The digital value corresponding to the analog measurements are processed in conjunction with a Non-Volatile Memory (NVM) 156 by firmware forming a part of the control board 150. The digital values arrived at are converted by a digital to analog (D/A) converter 158 for use in controlling the ROS 48, dicorotrons 28, 90, 100, 104 and 106. Toner dispensers 160 and 162 are controlled by the digital values. Target values for use in setting and adjusting the operation of the active machine components are stored in NVM.

IRD 54 is used to monitor the toner control patches written in interdocument zones and developed by the developer structures 58 and 60. For low developed mass, reflection IRDs are quite sensitive to the amount of toner present but the amount of developed toner is very sensitive to small changes in patch development field. As the patch developed mass is increased, the sensitivity to voltage variations is reduced but the output of the IRD suffers from a reduced signal-to-noise ratio. The toner patch voltage can vary for many reasons including dirt (i.e. toner) buildup on the patch generator lens, variations in the patch generator exposure LED's, changes (fatigue, dark decay, etc) in the P/R PhotoInduced Discharge Curve (PIDC). In a tri-level xerographic system the black toner patch voltage is also affected by wrong-sign color background development and voltage loss via conductivity of the color developer brush.

$ESV_1$ and $ESV_2$ monitor the various control patch voltages to allow for feedback control. While the system is constantly adjusting the patch generator exposure to keep the toner patch voltage at its proper target, small errors in the patch voltage are inevitable. This can result in small changes in the patch development field and associated variations in the developed patch mass. This, in turn, can finally lead to shifts in the developer housing toner concentration.

However, this problem is avoided by using the ESV readings to adjust the IRD readings of each toner patch. For the black toner patch $ESV_2$ readings are used to monitor the patch voltage. If the voltage is above target (high development field) the IRD reading is increased by an amount proportional to the voltage error or voltage difference. Conversely, if $V_{tb}$ is below target, the IRD reading is reduced by such an amount.

For the color toner patch $ESV_1$ readings and the dark decay projection to the color housing are used to make a similar correction to the color toner patch IRD readings (but opposite in sign because, for color, a lower voltage results in a higher development field). To this end both $ESV_1$ and $ESV_2$ are used to measure the charge on the color toner patch and an interpolated value is calculated from these measured values according to the following formula:

$$V_{tc} @ \text{Color} = V_{tc} @ ESV_1 - 0.465\,(V_{Mod} @ ESV_1 - V_{Mod} @ ESV_2)$$

Actuation of the pump 157 for a predetermined period of time is effected in accordance with printer usage. Thus, the more the printer is used the more oil is supplied to the wick pan assembly 127 and conversely the less the printer is used the less oil is supplied to the wick pan assembly.

An example of an oil dispensing algorithm contained in components forming part of the electronics module 6 and the bytes in NVM 156 required for execution thereof are as follows:

| nvm location | Description |
|---|---|
| 180 | This byte represents the maximum adjustment from the value in NVM loc. 610. |
| 610 | This byte represents the minimum number of prints (times 10) between fuser oil dispense or pump actuations. |
| 611 | This byte represents how much to increment the counter for the first print of a job. |

The oil dispensing algorithm has two parts. The first part of the algorithm is the COUNTING portion. The second portion is the TRIP POINT. The COUNTING portion will be described first.

COUNTING

A print switch 161 located in the pre-transfer area (see FIG. 3) generates a signal each time a print is created. A simplex print is counted as one print while a duplex print is counted as two prints. The signals are fed to a random access memory (RAM) 163 where they are used for calculating the number of print equivalences or agent copies for use in determining when the pump 157 is actuated for supplying silicone oil to the wick pan assembly. The aforementioned calculation NVM byte value in location 610 is 5 (typically it is 20, but for this illustration it will be 5 for simplification of the example) The byte value in location 611 is 12. The oil consumed per print is calculated by dividing the NVM byte value in location 611 by the number of the print in a job and adding 1 yielding a print equivalency value which corresponds to an amount of oil consumed for that print.

Now that it is known how each print through the fuser increments the counter in NVM location 610, the second portion of the algorithm can be addressed, the TRIP POINT. In the example, the trip point was set to 5, (NVM bye value in location. $610 \times 10 = 50$). The value 50 is the result of multiplying the byte value in NVM location 610 using a times ten counter. This means that when the total oil used reaches 50 or more, the pump is turned "ON" for a predetermined period of time, for example, 65 seconds. To simulate a machine which varies in the number of prints each day it produces, it is necessary to understand how a WICK oiling system works. Unlike a RAM system which uses only the oil needed by the system, a WICK system pumps oil, and does not have any feedback to determine whether the oil is being used or not. In the field, a tech rep who knows a machine will be running higher volumes, will set the NVM value in location 610 to a lower value, thereby supplying more oil. If he knows a machine will be running lower volumes, he will set the NVM value in location 610 to a higher value, thereby supplying less oil. However if a machine varies its volume rate from week to week, the machine does not have enough oil in the system at times (causing offset), and at other times having too much (causing drips or spills). An illustration of the print equivalency and oil pump activation are provided in the table below.

A dynamic oil algorithm to be discussed hereinafter corrects the foregoing problems of offset and oil dripping, in that, the TRIP POINT is varied in accordance with machine usage. Based on the prints per hour the machine produces, the value in NVM location 610 is modified.

| Job Number | OilUsed (Zeroed only at power up.) | Total OilUsed | Pump |
|---|---|---|---|
| Job 1 Print 1 | (12 ÷ 1) + 1 = 13 | 13 | off |
| Job 1 Print 2 | (12 ÷ 2) + 1 = 7 | 20 | off |
| Job 1 Print 3 | (12 ÷ 3) + 1 = 5 | 25 | off |
| Job 1 Print 4 | (12 ÷ 4) + 1 = 4 | 29 | off |
| Job 1 Print 5 | (12 ÷ 5) + 1 = 3 | 32 | off |
| Job 2 Print 1 | (12 ÷ 1) + 1 = 13 | 45 | off |
| Job 3 Print 1 Side 1 | (12 ÷ 1) + 1 = 13 | 58 (Agent Copies reset to 8) | on (for 65 sec. or 78 sec.) |
| Job 3 Print 1 Side 2 | (12 ÷ 2) + 1 = 7 | 15 | on (for 65 sec. or 78 sec.) |
| Job 3 Print 2 Side 1 | (12 ÷ 3) + 1 = 5 | 20 | on (for 65 sec. or 78 sec.) |
| Job 3 Print 2 Side 2 | (12 ÷ 4) + 1 = 4 | 24 | on (for 65 sec. or 78 sec.) |
| Job 3 Print 3 Side 1 | (12 ÷ 5) + 1 = 3 | 27 | on (for 65 sec. or 78 sec.) |
| Job 3 Print 3 Side 2 | (12 ÷ 6) + 1 = 3 | 30 | on (for 65 sec. or 78 sec.) |
| Job 3 Print 4 Side 1 | (12 ÷ 7) + 1 = 2 | 32 | on (for 65 sec. or 78 sec.) |
| Job 3 Print 4 Side 2 | (12 ÷ 8) + 1 = 2 | 34 | on (for 65 sec. or 78 sec.) |

Once the pump is "ON", it will remain "ON" for the time of either 65 or 78 seconds, even if the machine ends a job.

Assuming, NVM values for locations 610 and

Assuming, NVM values for locations 610 and 180 are set to 20 and 4, respectively, and in the first hour 4500 prints are produced, in the second hour the PPH volume again is 4500, in the third hour 99 prints are produced and in the fourth hour a PPH volume of 1500 is produced, the following would occur. After the first hour, the TRIP POINT would reset from 20 to 19 (see the graphic below). The effect of resetting the value of the trip point to a lower value is to increase the amount of oil dispensed through the action of the pump. This is because the pump will turn on sooner than the previous time because of the lower set point. After the second hour the TRIP POINT is again lowered. This time it is lowered from 19 to 18. If the third hour had produced 4500 prints again, the TRIP POINT would have again been lowered from 18 to 17, however, after the third hour since only 99 prints were made the TRIP POINT is not changed at all. It remains at 18. In the fourth hour only 1500 prints were produced. Since a PPH volume greater than 99 and less than 3714 was detected, the TRIP POINT is moved in the opposite direction and is changed from 18 back to 19. Thus, the TRIP POINT can increase, decrease or stay the same depending upon the number of prints produced in one hour.

The value in NVM location 180 represents a range-of-travel variable for the value in location 610. When set to zero, the TRIP POINT always remains equal to the value in location 610. When set to a value other than zero, the value in location 610 can be varied by that value.

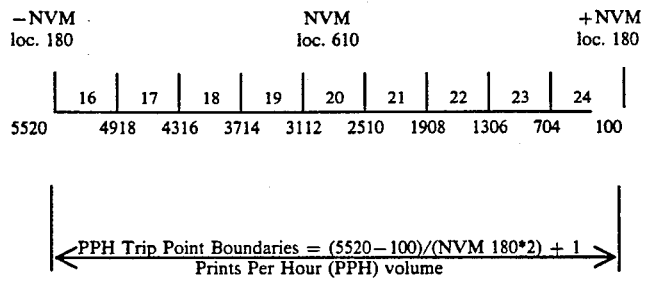

| Print Count | "Agent Count" | "Agent Copies" | Release Agent Pump |
|---|---|---|---|
| 0 | 0 | 0 | OFF |
| 1 | −10 + 13 | 1 | |
| | 3 | | |
| 2 | −10 + 10 | 2 | |
| | 0 | | |
| 3 | 5 | | |
| 4 | 9 | | |
| 5 | −10 + 12 | 3 | |
| | 2 | | |
| 6 | 5 | | |
| 7 | 8 | | |
| 8 | −10 + 10 | 4 | |
| | 0 | | |
| 9 | 2 | | |
| 10 | 4 | | |
| 11 | 6 | | |
| 12 | 8 | | |
| 13 | 9 | | |
| 14 | −10 + 10 | 5 | |
| | 0 | | |
| 24 | −10 + 10 | 6 | |
| | 0 | | |
| 154 | −10 + 10 | 19 | |
| | 0 | | |
| 164 | −10 + 10 | 20 | ON |
| | 0 | 0 | |
| 165 | 1 | | |
| 166 | 2 | | |
| 174 | −10 + 10 | 1 | |
| | 0 | | |
| 262 | 8 | 9 | |
| 263 | 9 | 9 | OFF |
| 264 | −10 + 10 | 10 | |
| | 0 | | |
| 364 | −10 + 10 | 20 | ON |
| | 0 | 0 | |

Figure 7:
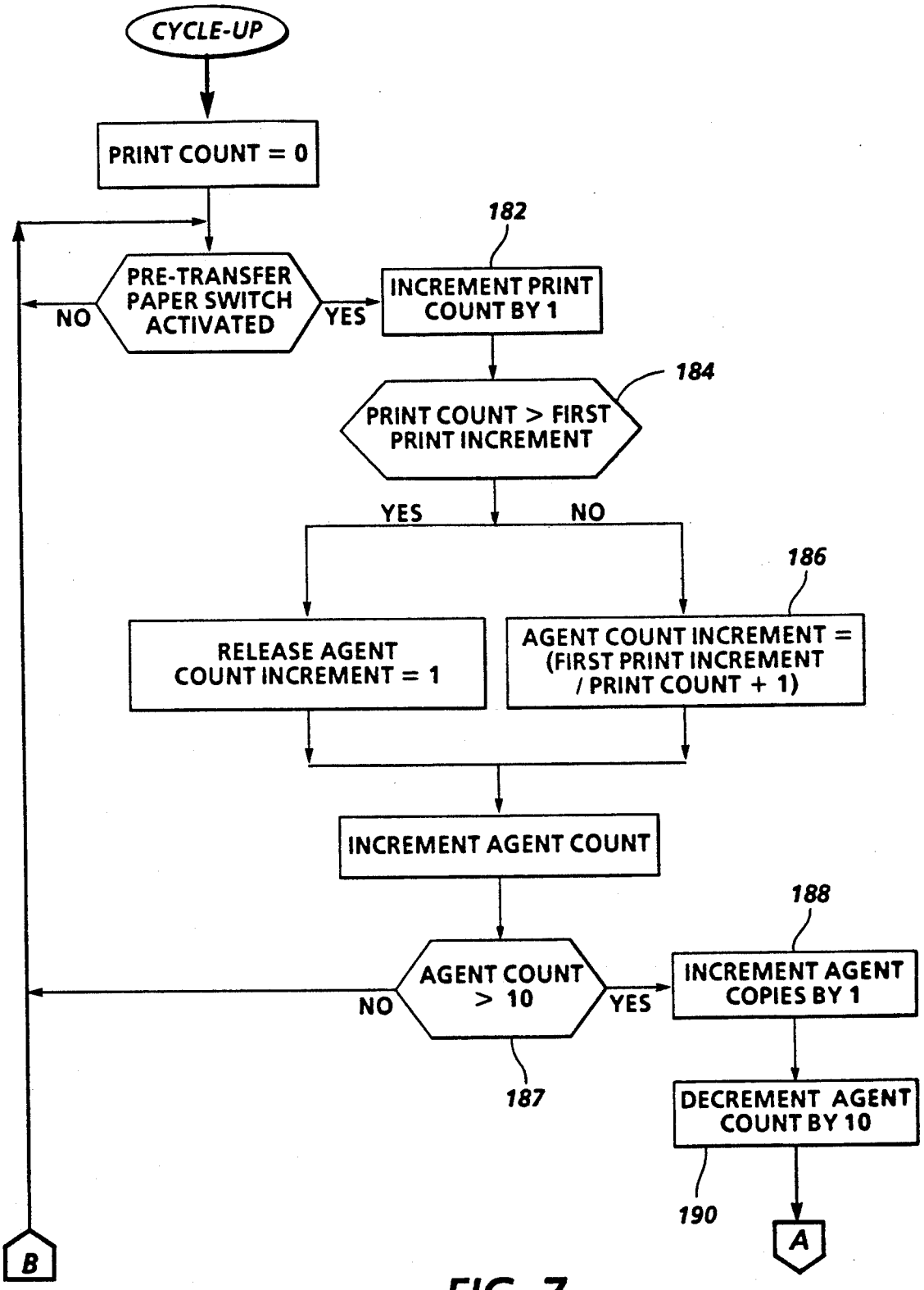
FIG. 7 is a portion of a flow diagram or fuser release agent dispensing algorithm.

Operation of the release agent management control of the present invention will now be described in connection with the flow diagrams illustrated FIGS. 7 and 8 and the table above. According to the process flow diagram illustrated in FIG. 7, for each actuation of print switch 161 (block 180), following machine cycle-up, the print count is incremented (block 182). According to the example run illustrated in the table above for NVM values listed, the print count as determined (block 184) is not greater than the first print increment value contained in NVM location 611 so the print equivalency or agent count is calculated (block 186) by dividing the first print increment of 12 by the print count of 1 and then adding 1 which results in an agent count of 13 as shown in column 2, row 2 of the table on page above. If the agent count is greater than 10 (block 187) then "agent copies" is incremented (block 188) by 1 and the "agent count" is decremented (block 190) by 10 as illustrated in column 2, row 2 of the table on page above. As shown therein, the "agent count" becomes 3 while the "agent copies" is 1.

Figure 8:
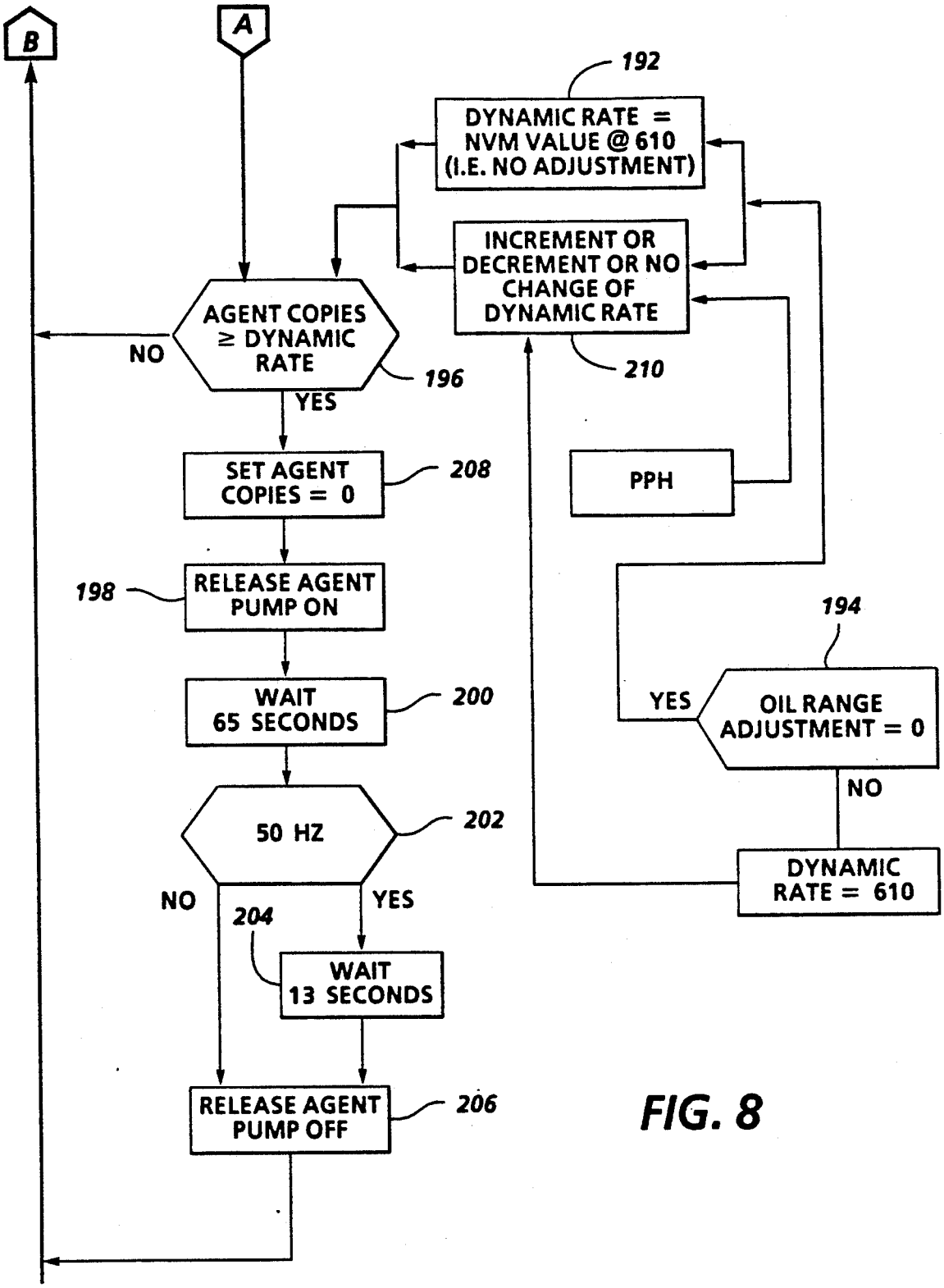
FIG. 8 is another portion of the flow diagram illustrated in FIG. 7.

The continuation of the flow diagram is illustrated in FIG. 8. As shown therein, there is no dynamic oil rate adjustment(block 192) because the oil range adjustment is set to 0 (block 194). As illustrated in the table above, in the row where the print count is one hundred and sixty-four, the agent copies value is equal to 20 (block 196) which is the threshold value. After the threshold value is reached the agent copies value is set to zero (block 208). This results in the actuation of the release agent motor and pump (block 198). for a period of sixty-five seconds (block 200). If the power to the pump motor is 50 Hz (block 202) then the pump remains on for another thirteen seconds (block 204). After the pump has been activated for the predetemined time, it is deactivated (block 206).

In the situation where the oil range adjustment (block 192) or NVM location 180 is greater than zero, then NVM location 610 is decremented (block 210) or incremented according to machine usage as described above.

We claim:

1. Apparatus for applying release agent management material to a fuser member for fixing toner imaged prints, said apparatus comprising:

a wick structure for applying release agent material to an external surface of said fuser member;

means for counting a number of prints created and generating signals representative of said number of prints;

means for calculating print equivalency values for prints counted, said calculated equivalency values being representative of release agent used for fusing said prints;

means representing a number of print equivalency values calculated;

means representative of a predetermined print equivalency value; and means for supplying release agent material to said wick for a predetermined period of time only after said predetermined equivalency value is exceeded.

2. Apparatus according to claim 1 wherein said representing means comprises resettable means for accumulating an indication of print equivalences.

3. Apparatus according to claim 2 including means for resetting said accumulating means after said predetermined equivalency value is reached.

4. Apparatus according to claim 1 wherein equivalency values are calculated according to the following formula:

If a calculated print equivalency value<=said predetermined print equivalency value, then the print equivalency=(said predetermined print equivalency value/said number of prints)+1

If a calculated print equivalency value > Said predetermined print equivalency value, then the print equivalency = 1 .

5. Apparatus according to claim 4 wherein said representing means comprises resettable means for accumulating an indication of print equivalences.

6. Apparatus according to claim 5 including means for resetting said accumulating means after said predetermined equivalency value is reached.

7. apparatus according to claim 3 including means for effecting engagement and disengagement of said wick member from a surface of said fuser member.

8. Apparatus according to claim 7 wherein said means for effecting disengagement of said wick with said surface being effective during cycle up, dead cycling and cycle down of said printer.

9. Apparatus according to claim 8 wherein said wick structure comprises a fuser wick and a donor wick.

10. Apparatus according to claim 9 including means for causing said period of time to be one of two time periods.

11. A method for applying release agent management material to a fuser member for fixing toner imaged prints, said apparatus comprising:

counting a number of prints created and generating signals representative of said number of prints;

calculating and representing print equivalency values for prints counted, said calculated equivalency values being representative of release agent used for fusing said prints;

comparing said print equivalency values to a predetermined print equivalency value; and supplying release agent material to a wick structure for a predetermined period of time only after said predetermined equivalency value is exceeded by said print equivalency values.

12. The method according to claim 11 including the step of changing print equivalences represented once said predetermined equivalency value is exceeded by said print equivalency values.

13. The method according to claim 12 wherein period of time is selected from one of two time periods for supplying of release agent material to said wick structure.

14. The method according to claim 11 wherein equivalency values are calculated according to the following formula:

If a calculated print equivalency value <= said predetermined print equivalency value, then the print equivalency = (said predetermined print equivalency value/said number of prints) + 1

If a calculated print equivalency value > said predetermined print equivalency value, then the print equivalency = 1 .

15. The method according to claim 14 including the step of changing print equivalences represented once said predetermined equivalency value is exceeded by said print equivalency values.

16. The method according to claim 15 wherein period of time is selected from one of two time periods for supplying of release agent material to said wick structure.

17. The method according to claim 14 including the step of effecting engagement and disengagement of said wick structure from a surface of said fuser member.

18. The method according to claim 17 wherein said step of effecting engagement and disengagement of said wick structure during cycle up, dead cycling and cycle down of said printer.

19. The method according to claim 18 wherein said step of supplying release agent material to said wick structure is effected via a donor wick and a fuser wick the latter of which contacts said fuser surface.

* * * * *